United States Patent [19]

Closmann

[11] Patent Number: 4,633,948

[45] Date of Patent: Jan. 6, 1987

[54] STEAM DRIVE FROM FRACTURED HORIZONTAL WELLS

[75] Inventor: Philip J. Closmann, Houston, Tex.

[73] Assignee: Shell Oil Company, Houston, Tex.

[21] Appl. No.: 664,715

[22] Filed: Oct. 25, 1984

[51] Int. Cl.[4] ..... E21B 43/17; E21B 43/24

[52] U.S. Cl. ..... 166/271; 166/50; 166/245

[58] Field of Search ..... 166/50, 271, 245, 272, 166/308

[56] References Cited

U.S. PATENT DOCUMENTS

| | | | |
|---|---|---|---|
| 1,816,260 | 7/1931 | Lee | 166/50 |
| 2,171,416 | 8/1939 | Lee | 166/50 |
| 3,129,758 | 4/1964 | Closmann | 166/245 |
| 3,501,201 | 3/1970 | Closmann et al. | 166/271 |
| 3,835,928 | 9/1974 | Strubhar et al. | 166/308 |
| 3,878,884 | 4/1975 | Raleigh | 166/271 |
| 4,200,152 | 4/1980 | Foster et al. | 166/50 |
| 4,223,729 | 9/1980 | Foster | 166/271 |
| 4,410,216 | 10/1983 | Allen | 166/245 |

*Primary Examiner*—George A. Suchfield
*Assistant Examiner*—Bruce M. Kisliuk

[57] ABSTRACT

Oil is produced by drilling parallel horizontal wells within a deep subterranean reservoir, extending parallel vertical fractures between the wells, heating the reservoir by flowing hot fluid through all fractures and producing oil by displacing fluid between the fractures.

1 Claim, 2 Drawing Figures

STEAM DRIVE FROM FRACTURED HORIZONTAL WELLS

BACKGROUND OF THE INVENTION

This invention relates to producing oil from relatively deep viscous oil reservoirs such as tar sands, or the like. More particularly the invention relates to improving the efficiency with which such a reservoir is heated and oil is produced by utilizing horizontal wells which are interconnected by vertical fractures.

In tar sand deposits, there is frequently little possibility of injecting significant quantities of fluid. Although such reservoirs may have a high absolute permeability, due to a high tar saturation and viscosity and a low water saturation, the effective permeability may be very low at the reservoir temperature. In shallow deposits it is usually feasible to fracture a reservoir and interconnect wells by means of horizontal fractures. In thick, shallow reservoirs, overlapping pairs of such horizontal fractures can be utilized in a steam drive process of the type described in my U.S. Pat. No. 3,129,758.

However, in deep earth formations, hydraulic fractures are preferentially vertically oriented, particularly at depths significantly greater than about 1,000 feet. In general, fractures tend to be aligned perpendicular to the least compressive stress within the formation. In the deeper reservoirs, the vertical compressive stress due to the weight of the overburden is usually the greatest. Therefore, hydraulic fractures are preferentially vertical fractures aligned along a horizontal direction dictated by the local tectonics of the region.

SUMMARY OF THE INVENTION

In accordance with the present invention, at least two horizontal wells are drilled into a viscous oil reservoir in which hydraulic fractures tend to be vertical. The wells are arranged so that at least one is near the top and at least one is near the bottom of the reservoir and all of the wells are aligned substantially parallel to each other and substantially perpendicular to the least principal horizontal stress within the reservoir. A series of substantially vertical fractures are formed and extended between the wells. The reservoir is heated by circulating hot fluid through substantially all of the fractures at substantially the same time. With fluid communication between the wells and fractures arranged to the extent required, hot fluid is selectively injected into alternate ones of the fractures and fluid is selectively produced from the fractures adjacent to those into which the hot fluid is injected. Oil is recovered from the fluid being produced.

DESCRIPTION OF THE INVENTION

Figure 1:
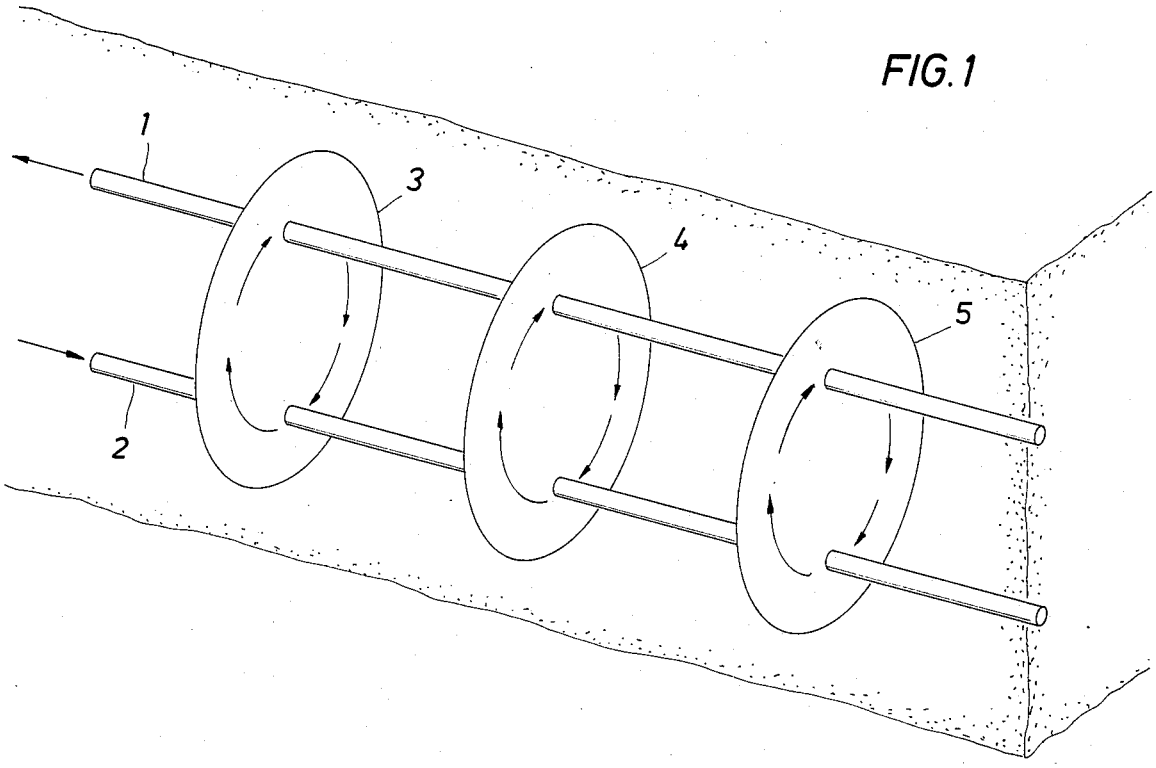
FIG. 1 is a schematic illustration of a tar sand reservoir containing wells and fractures arranged for practicing the present invention.

FIG. 1 shows a portion of a reservoir formation in which substantially horizontal portions of wells 1 and 2 are located near the respective upper and lower portions of the reservoir. Vertical fractures 3, 4, and 5 have been formed within the reservoir and extended between the wells. The wells are aligned so that their horizontal portions are substantially parallel and substantially perpendicular to the least principal horizontal stress within the reservoir. In such a situation, hydraulically induced fractures tend to be vertical and substantially parallel to each other, as shown in the Figure.

Horizontal wells can readily be drilled by known directional drilling techniques for deviating wells and/or techniques for advancing wells horizontally from the faces of mine shafts or outcrops, or the like. The aligning of such wells in a direction perpendicular to the least principal horizontal stress can readily be based on determinations made by known types of procedures for locating such direction. For example, a test well within the reservoir formation can be hydraulically fractured and measurements made of the fracture orientation. Such data can be combined with seismic and other geophysical or geochemical data to determine the orientation of localized stresses in the zone of interest.

In the situation illustrated in FIG. 1, fluid communication has been established between both of the wells 1 and 2 and all of the fractures 3, 4, and 5. The reservoir is being preheated by circulating hot fluid, such as steam, into all of the fractures through well 2, and out of all of the fractures through well 1.

As known to those skilled in the art, at least in some situations in which it is desired to form a hydraulic fracture and extend it into communication with an adjacent well, it is advantageous to inject the fracturing fluid through one well while maintaining an adjacent well open for fluid inflow in the zone likely to be encountered by a fracture. Such a procedure provides both a pressure sink tending to guide the direction of the fracture extension, and a means for detecting the encountering of the second well by the fracture. In addition, where a pair of such wells are completed into the interval desired to be fractured, it is sometimes advantageous to inject fracturing fluid alternatively or concurrently through both of the wells.

In preheating a reservoir in accordance with this invention, the hot fluid injected during the preheating can suitably be steam, air, hot gas, hot water, the products of an underground combustion (e.g. utilizing the oil exposed along the walls as the fractures as some or all of the fuel) or the like. The preheating is preferably continued for a predetermined period of time selected on the basis of the character of the formation, the spacing between the fractures, the temperature of the injected fluid and the like. The preheating can be continued until a temperature sensor or observation well between adjacent fractures and/or the temperature of the outflowing fluid indicates that a sufficient temperature rise has been obtained within the reservoir. The degree of heating to be sought will depend on the variation of viscosity with temperature of the reservoir oil or tar to be produced.

Figure 2:
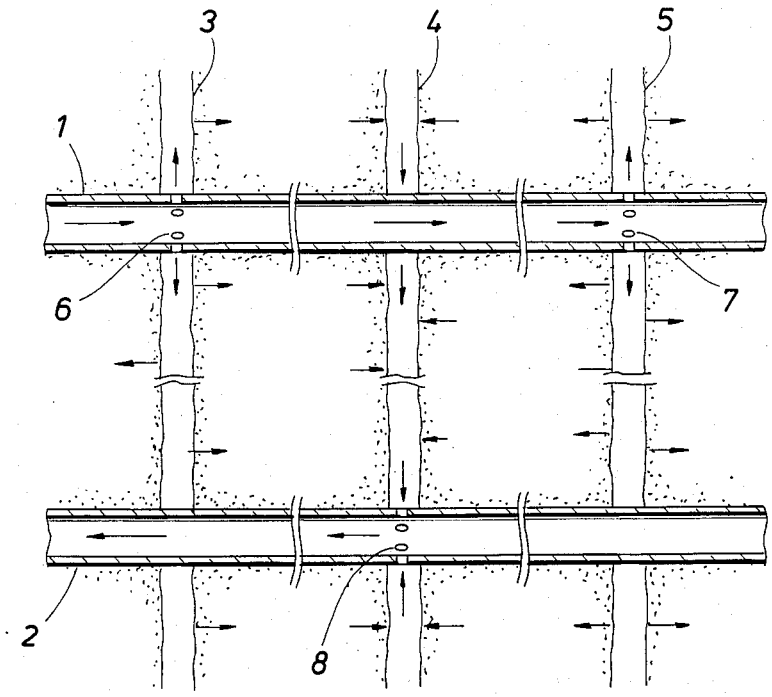
FIG. 2 shows an arrangement of fluid communications between wells and fractures suitable for practicing the present invention.

FIG. 2 shows details of a fluid communication arrangement between the wells and the fractures which is particularly suitable for use in producing oil from a preheated reservoir. As shown in FIG. 2, the well 1 is opened into fluid communication with the alternate fractures 3 and 5 by means of perforations 6 and 7. The well 2 is opened into fluid communication with the fracture 4, which is adjacent to both the fractures 3 and 5 into which hot fluid is injected, by means of perforations 8. As indicated above, a particularly suitable method of establishing the well connecting fractures can be based on initially casing and perforating each of the parallel and horizontal wells at the locations selected for initiating the fractures and/or those expected to be encountered by extensions of the fractures. A pattern of selective communication between the wells and the fractures such as that shown in FIG. 2 can then be established by sealing selected ones of the openings, such as those between well 1 and fracture 4, well 2 and fracture 3, and well 2 and fracture 5.

Known methods and devices for sealing perforations, or other openings between wells and fractures, can suitably be used. For example, casing perforations can be sealed by means of packers providing a flow-through channel, squeezing cement into the fractures (with or without squeezing in sand to aid in the establishing of the cement block), injecting fracture plugging particles and/or curable resins, or the like.

Alternatively, a need for selectively closing communication paths between any of the wells and fractures can be avoided by opening more than two horizontal and parallel wells into the reservoir. In one such arrangement, utilizing the illustrated communications between wells 1 and 2 and fractures 3, 4, and 5, a second such well spaced horizontally from well 1 near the upper boundary of the reservoir can be selectively perforated at the zones selected for initiating fracture 4 or expected to be encountered by the fracture 4. A second well horizontally spaced from well 2 near the bottom portion of the reservoir can be selectively perforated at the location from which the fracture 5 is to be initiated or is expected to encounter. In utilizing such multiple wells, the forming of perforations intended to be encountered by the fractures can be deferred until the fractures have been formed and extended into the vicinity of the wells to be perforated, so that the locations in which to form the perforations can be determined by means of logging, seismic, or the like, fracture detecting measurements.

Where desired, a pair of fractures such as 3 and 4 can be initially established and preheated by circulating hot fluid, as shown by the arrows in FIG. 1, then produced by selectively displacing hot fluid between those fractures as shown by the arrows in FIG. 2. Where the wells of a single pair of wells are initially opened into both of the fractures during the preheating of the reservoir, selected ones of such openings are preferably closed (as shown in FIG. 2) to initiate the displacing of fluid between the fractures while the reservoir is still hot. In addition, where the pattern of treatment is to be extended farther along the wells, it may be desirable to interrupt the production operation while the reservoir is still hot, then close the communication between well 1 and fracture 3 by plugging perforations 6, opening perforation 7 in the location desired for fracture 5, completing that fracture, then preheating between fractures 4 and 5, and subsequently selectively producing by displacing fluid between fractures 4 and 5. In treating a relatively large reservoir, additional patterns of upper and lower wells such as wells 1 and 2 can be arranged in substantially parallel rows which are horizontally spaced within the reservoir.

What is claimed is:

1. In a process for producing oil from a relatively deep viscous oil reservoir, an improvement for increasing the rate at which oil production is initiated and maintained, comprising:

opening at least two horizontal wells within a portion of the reservoir in which hydraulic fractures tend to be vertical with said wells being substantially parallel to each other, perpendicular to the least principal compressive stress, and positioned so that at least one well is located near the top and at least one well is located near the bottom of the reservoir;

extending at least three substantially parallel vertical fractures between the wells;

heating at least one portion of the reservoir which lies between at least the outermost pair of said fractures by circulating hot fluid through all of those fractures at substantially the same time;

selectively injecting steam into at least said outermost pair of fractures adjoining a preheated portion of the reservoir while selectively producing fluid from at least one intermediately located fracture extending into a preheated portion of the reservoir between the pair of fractures into which steam is being injected; and recovering oil from fluid being displaced horizontally from the pair of fractures into which steam is injected and being produced from said intermediately located fracture.

* * * * *